US005823486A

United States Patent [19]

Smith et al.

[11] Patent Number: 5,823,486

[45] Date of Patent: Oct. 20, 1998

[54] UNIVERSAL FLEXIBLE ARM

[75] Inventors: Margaret K. Smith, 4565 Moonlight Way, Paradise Valley, Ariz. 85253; Jill M. Duggan, Scottsdale, Ariz.; Christopher M. Stalzer, Scottsdale, Ariz.; Scott C. Smith, Scottsdale, Ariz.; George J. Mowry, Fountain Hills, Ariz.

[73] Assignee: Margaret K. Smith, Paradise Valley, Ariz.

[21] Appl. No.: 795,144

[22] Filed: Feb. 7, 1997

[51] Int. Cl.[6] ..... A47D 15/00

[52] U.S. Cl. ..... 248/104; 248/103

[58] Field of Search ..... 248/102, 103, 248/104, 105, 106, 107, 161; 446/227, 369, 370, 374

[56] References Cited

U.S. PATENT DOCUMENTS

| | | | |
|---|---|---|---|
| 1,900,691 | 3/1933 | Carlson | 446/227 X |
| 2,496,478 | 2/1950 | Kinnebrew | 248/103 |
| 2,784,261 | 3/1957 | Anklesaria | 248/103 X |
| 3,398,919 | 8/1968 | Tokar | 248/103 |
| 3,627,244 | 12/1971 | Nicholas | 248/103 |
| 3,635,431 | 1/1972 | Mariner | 248/104 |
| 3,850,393 | 11/1974 | Marquard | 248/102 |
| 3,993,274 | 11/1976 | Jansen | 248/107 |
| 4,114,847 | 9/1978 | Bogensberger | 248/104 |
| 4,320,833 | 3/1982 | Bass | 248/104 |
| 4,416,438 | 11/1983 | King | 248/102 |
| 4,482,117 | 11/1984 | Besek, Jr. | 248/103 |
| 4,630,793 | 12/1986 | Hunter | 248/102 |
| 4,723,801 | 2/1988 | Musumeci et al. | 294/33 |
| 4,735,388 | 4/1988 | Marks | 248/103 |
| 4,750,696 | 6/1988 | Shan-Liang | 248/102 |
| 4,951,997 | 8/1990 | Kenney | 297/188 |
| 4,979,707 | 12/1990 | McErlean | 248/104 |
| 4,989,811 | 2/1991 | Millis et al. | 248/104 |
| 5,037,046 | 8/1991 | Mingledorff, Jr. | 248/106 |
| 5,083,732 | 1/1992 | Akamine | 248/104 |
| 5,092,549 | 3/1992 | Beech | 248/103 |
| 5,135,189 | 8/1992 | Ghazizadeh | 248/104 |
| 5,217,192 | 6/1993 | Oktayuren | 248/102 |
| 5,478,041 | 12/1995 | Mayne | 248/514 |
| 5,489,075 | 2/1996 | Ible | 248/104 |

*Primary Examiner*—Ramon O. Ramirez
*Assistant Examiner*—Long Dinh Phan
*Attorney, Agent, or Firm*—Steven Lin

[57] ABSTRACT

A flexible arm apparatus 1 that has a base clamp 10, a support arm 75, an interface attachment 100, and capable of receiving an attachment 131, 140, or 150. The base clamp 10 has a threaded knob 43 that is rotatably secured at two ends and is used to move a second jaw 17 relative to a first jaw 12. The rotation cup 80 is secured into the top of the base clamp 10 with a retainer ring 87. The rotation cup 80 receives a first end 77 of the support arm 75, and a second end 78 is received by the interface attachment 100. The interface attachment 100 comprises a lower interface component 101 and an interface-mid component 102. Changeable attachments 131, 140, and 150 are securable to the interface attachment by use of a pringle 131 or 141. The rotation cup 80 and the retainer ring 87 allow angular rotation of the first end 77 of the support arm 75 relative to the clamp base 10. The interface-mid component 102 allows angular rotation of the attachment relative to the second end 78 of the support arm 75

20 Claims, 6 Drawing Sheets

UNIVERSAL FLEXIBLE ARM

FIELD OF THE INVENTION

The present invention relates generally to a universal, flexible arm attachable and mountable to a surface, and, more particularly, to a universal, flexible arm which is able to be moved or maneuvered into a number of different positions or orientations.

BACKGROUND OF THE INVENTION

A. General Background of Flexible or Bendable Arms

Flexible or bendable arms that are attachable to a surface or that are supported by a base have been used for a number of different applications. For example, flexible or bendable arms have been attached to a surface and used for supporting or holding baby bottles, cups, lamps, or other such items. These flexible arms, which are attachable to a surface, have been able to provide different uses for toddlers, geriatric person(s), physically challenged person(s), etc. The flexible or bendable arms are able to provide a hands-free environment to the user of the arm and also are able to provide an easy or self positioning support for various items (i.e. baby bottles, cups, lamps, etc.).

Flexible arms attachable to a surface for holding baby bottles or cups have been particularly disclosed or taught in a number of prior art patents. Some examples of flexible arms attachable to a surface for holding baby bottles or cups are provided in the following prior art U.S. Pat. Nos.: 5,135,189 to Ghazizadeh, 5,489,075 to Ible, 5,083,732 to Akamine, 4,114,847 to Bogensberger, and 3,635,431 to Mariner.

At least two types of attachment components (i.e. clips or clamps) for attaching a flexible arm to a surface appear to be disclosed by some of the U.S. prior art patents. The first type of clip or clamp for attaching the flexible arms to a surface is a screw engagement or screw attachment type clamp. Some examples of arms that use a screw engagement or screw attachment type clamp are provided in the following prior art U.S. Pat. Nos.: 4,114,847 to Bogensberger, 3,635,431 to Mariner, 4,735,388 to Marks, 3,627,244 to Nicholas, 4,320,883 to Bass, 4,951,997 to Kenney, and 5,092,549 to Beech. A major problem with these screw engagement or screw attachment type clamps is that the screw travels forward and backward thereby creating excessive or awkward projection of the screw from the clamp. This excessive or awkward projection makes it difficult in some instances to mount the clamp in tight space situations.

The second type of clip or clamp for attaching the flexible arms to a surface is a spring actuated or spring held type clip or clamp. Some examples of flexible arms that use a spring actuated or spring held type clip or clamp for attaching a flexible arm to a surface are provided in the following prior art U.S. Pat. Nos.: 5,135,189 to Ghazizadeh, 5,489,075 to Ible, 3,635,431 to Mariner, and 4,482,117 to Besek.

Though the above discussed patents disclose useful inventions, there is still a need for further improvement in the field. More specifically, there is a need for improvements in the clipping or clamping mechanism for these devices. One of the major problems which exist in some of the prior art devices is the excessive extension or projection of the clamping means from the device thereby making attachment or placement of the device difficult.

Furthermore, there is a continuing need for improvements in the mechanisms which provide rotation (at either end of the arm) and/or flexation to the arm structure of the flexible arm. There is also a need to provide an improved interface between the flexible arm and a corresponding attachment. Additionally, there is a continuing need to further improve the safety features of these flexible arms.

SUMMARY OF THE INVENTION

It is an object of the present invention to provide an universal flexible arm.

It is another object of the present invention to provide an universal flexible arm useful for the care of toddlers, and physically challenged persons.

It is a further object of the present invention to provide an universal flexible arm which utilizes a stationary threaded screw to drive two jaw components relative to each other.

It is yet another object of the present invention to provide an universal flexible arm which is capable of rotating the support arm relative to the base clamp.

It is yet a further object of the present invention to provide an universal flexible arm with an attachment interface which allows rotation of secured attachments relative to the support arm.

It is another object of the present invention to provide an universal flexible arm which uses a pringle to secure an attachment to the attachment interface.

It is an object of the present invention to provide an universal flexible arm that can easily be attached to a baby car seat, a baby stroller, a baby carrier, and the like.

It is another object of the present invention to provide an universal flexible arm which is relatively lightweight.

It is another object of the present invention to provide an universal flexible arm which comprises more than one means for varying the position for the attachment.

In accordance with the present invention, there is provided an universal flexible arm comprising a base clamp attached to a surface and a flexible arm connecting the clamping portion to an attachment interface which works with a multitude of different holders and attachments.

It is still yet another object of the present invention to provide an universal flexible arm in which the threaded screw of the vice clamp does not advance with the vice jaw.

It is still yet a further object of the present invention to provide an universal flexible arm which is capable of being clamped onto both flat and tubular surfaces.

It is another object of the present invention to provide an universal flexible arm in which the bottle holder may be exchanged for a tray or cup attachment.

It is another object of the present invention to provide an universal flexible arm which combines all of the above objects.

BRIEF DESCRIPTION OF THE FIGURES

The novel features that are considered characteristic of the invention are set forth with particularity in the appended claims. The invention itself, however, both as to its structure and its operation together with the additional objects and advantages thereof will best be understood from the following description of the preferred embodiment of the present invention when read in conjunction with the accompanying drawings wherein:

DETAILED DESCRIPTION OF THE INVENTION

The present invention is a universal flexible arm apparatus 1 that is attachable and mountable to a surface and is adapted to receive various attachments that can be used for different purposes and moved or maneuvered into a number of different positions or orientations.

Figure 1:
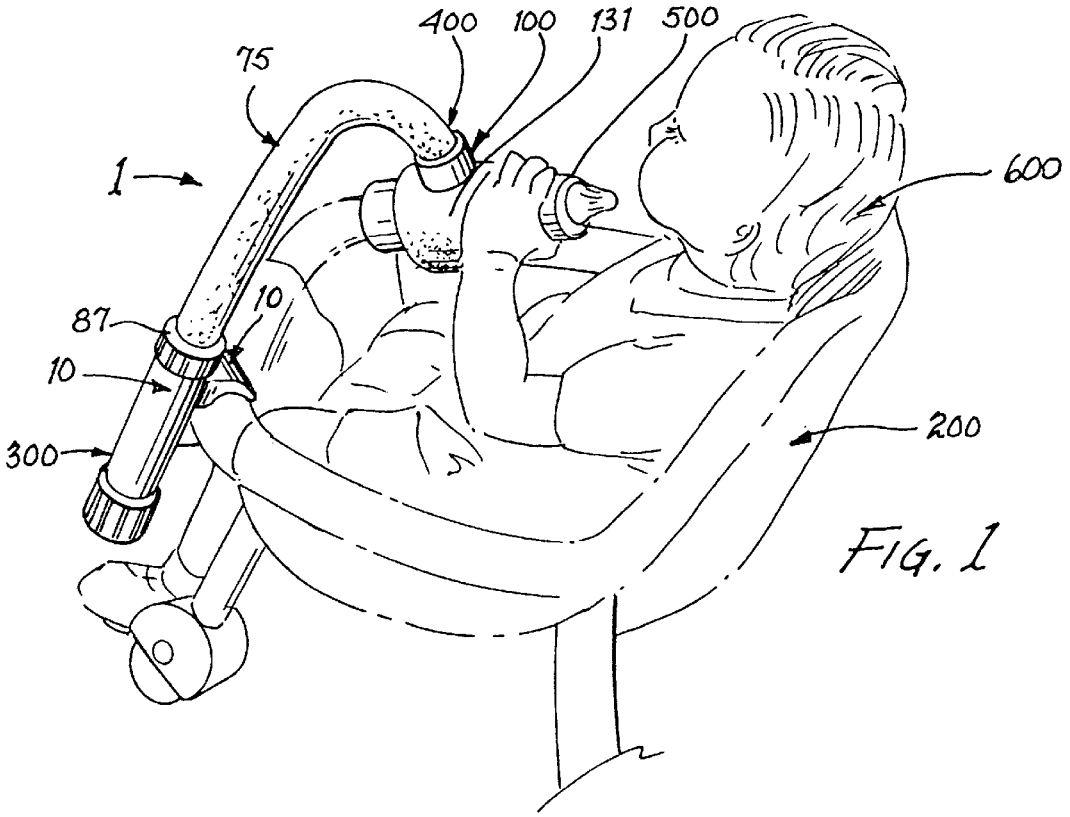
FIG. 1 is a perspective view of a first embodiment of the present invention removably attached to a baby seat wherein the first embodiment has a baby bottle/cup holder attached at one end.
Figure 2:
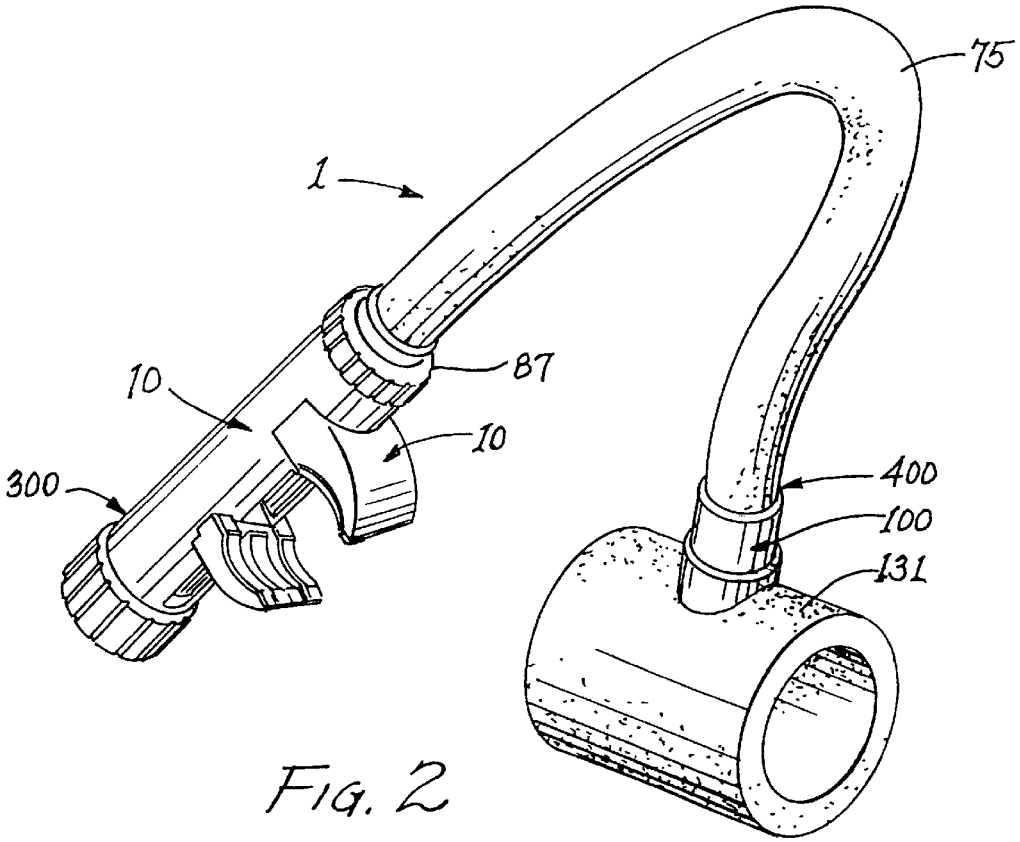
FIG. 2 is a perspective view of the first embodiment of the present invention.

FIGS. 1 and 2 show perspective views of a first embodiment of the present invention wherein the flexible arm apparatus 1 has a baby bottle/cup holder 131 attached at a general second end 400. In FIG. 1, the apparatus 1 of the present invention is shown being used and attached to a baby seat 200, but the apparatus 1 can be attached to other baby apparatus (i.e. including but not limited to baby strollers, carriages, tables, chairs, etc.) by a base clamp 10. The apparatus 1 also has a flexible support arm 75 with an attachment interface 100 at the general second end 400 of the flexible support arm 75. However, the present invention is not limited to the attachment of a baby bottle/cup holder 131 attached to the attachment interface 100, and any suitable attachment, including but not limited to a tray 140 shown in FIG. 9 and a bowl 150 shown in FIG. 10.

A. The General First End and Base Clamp of the Present Invention

1. Clamp Body

Figure 3:
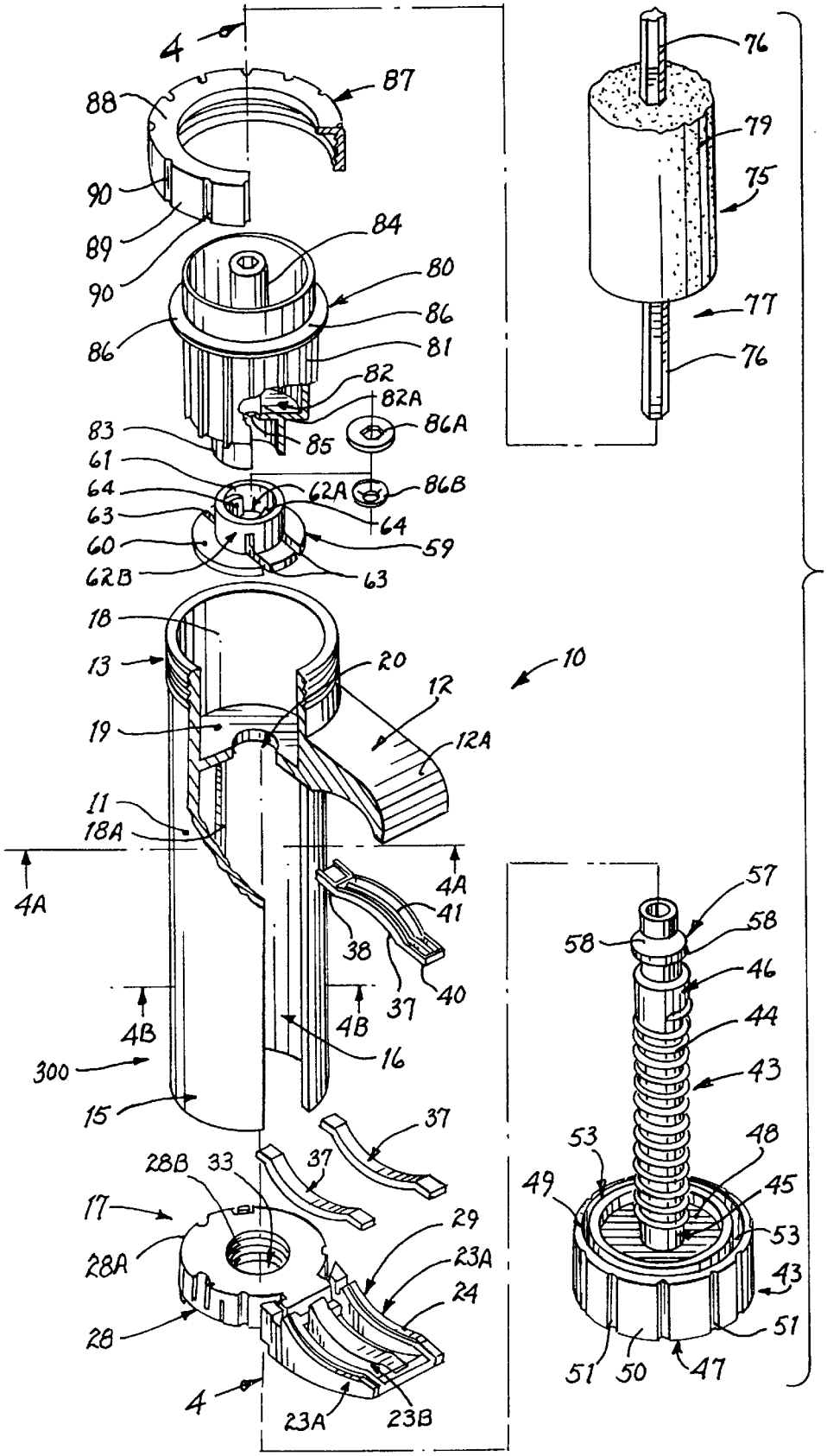
FIG. 3 is a cut-away exploded view of components at a general first end of the first embodiment of the present invention illustrating assembly of the components.
Figure 4A:
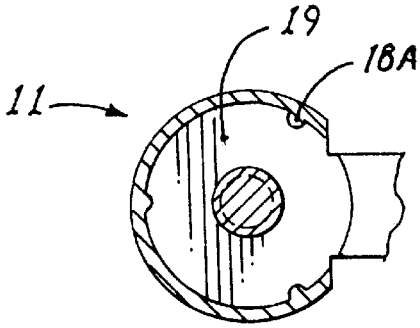
FIG. 4A is a cross-sectional view of the clamp body of the base clamp according to the line 4A—4A of FIG. 4 which shows the ribs and illustrates that the clamp body wall arrows
Figure 4B:
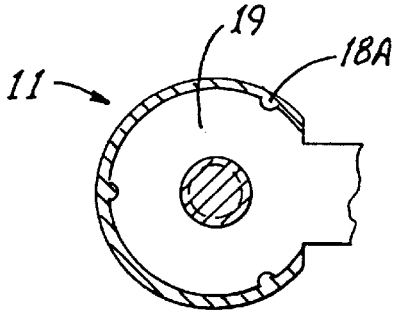
FIG. 4B is a cross-sectional view of the clamp body of the base clamp according to the line 4B—4B of FIG. 4 which shows the ribs and illustrates that the clamp body narrows.
Figure 4C:
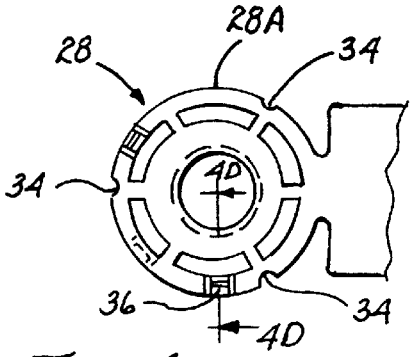
FIG. 4C a bottom view of the drive engage component of the second jaw.
Figure 4D:
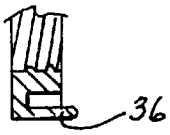
FIG. 4D is a partial cross-sectional view of the drive engage component according to the line 4D—4D of FIG. 4C.
Figure 4E:
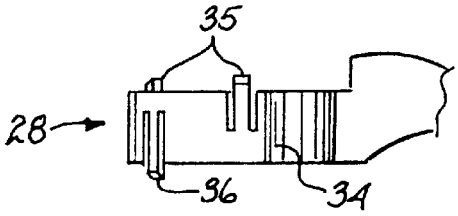
FIG. 4E is a side view of the drive engage component of the second jaw.
Figure 4:
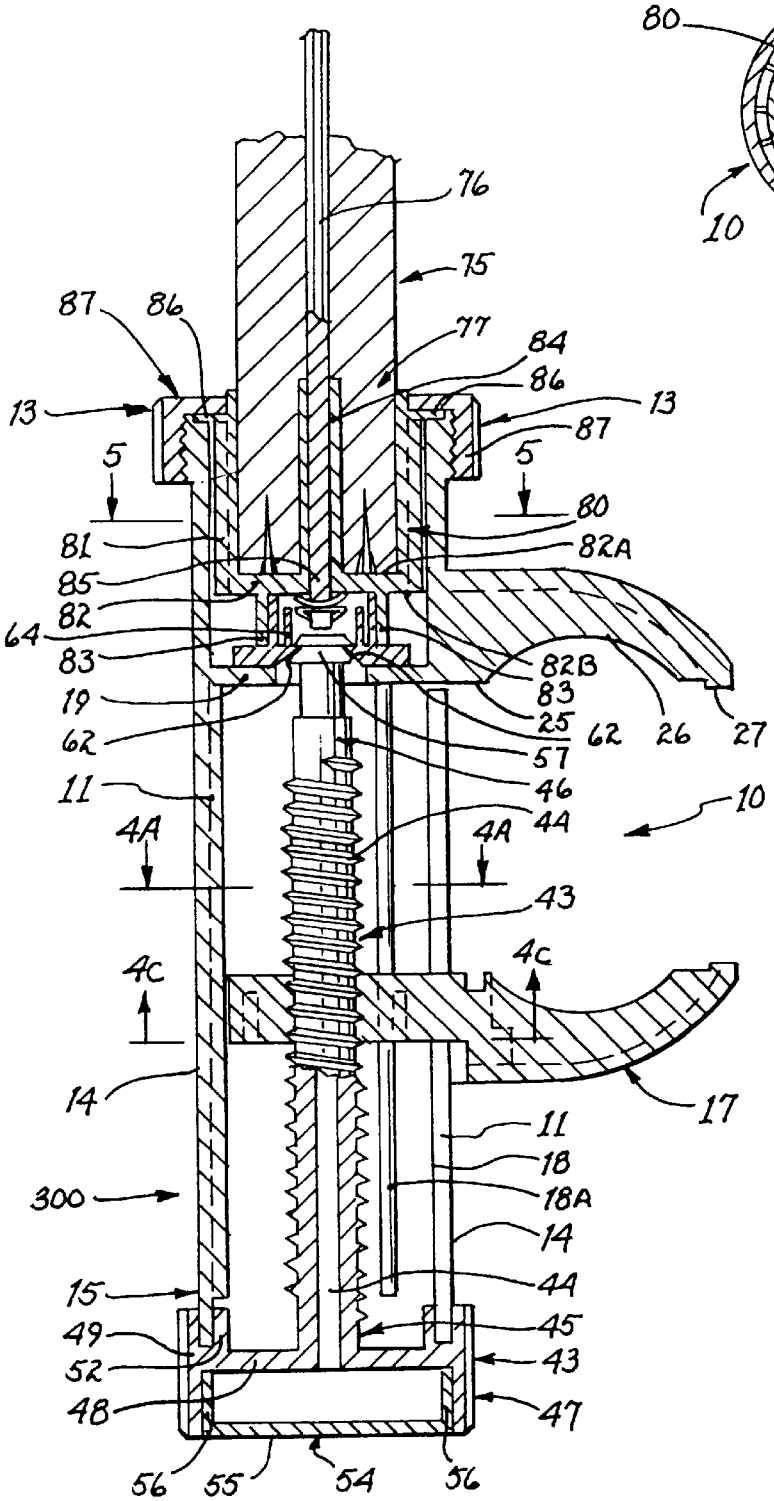
FIG. 4 is a cross-sectional side view of the components according to the line 4—4 of FIG. 3 which shows the working relationship of the components to each other.

FIGS. 3 and 4 show more detailed views of a general first end 300 of the flexible arm apparatus 1. Base clamp 10 is located at the general first end 300 of the flexible arm apparatus 1. The base clamp 10 functions to clamp and hold the flexible arm apparatus 1 to a surface (i.e. including but not limited to a round or flat surface).

The base clamp 10 has a clamp body 11 with an attached fixed first jaw 12. FIGS. 3 and 4 show that the clamp body 11 has a generally cylindrical shape. An end 13 of the clamp body 11 (shown as the top end in FIGS. 3 and 4) is externally threaded. The fixed first jaw 12 is attached (i.e. including but not limited to being integrally attached) to an outer surface 14 of the clamp body 11 relatively near the end 13 and below the external threading as shown in FIGS. 3 and 4. A portion of the clamp body 11 running centrally and longitudinally from the fixed first jaw 12 to a second end 15 of the clamp body 11 is cut away so that a running channel 16 is provided for a movable second jaw 17.

In FIGS. 3 and 4, a clamp body partition 19 is shown to have a washer shape. The partition 19 is located within an inside surface 18 of the clamp body 11 so that flat surfaces of the partition 19 are perpendicular to the clamp body 11 longitudinal axis. In being similar to the shape of a washer, the clamp body partition 19 has a centrally located opening or aperture 20. The clamp body partition 19 is located relatively near the first jaw 12 (i.e. in FIGS. 3 and 4, partition 19 is shown at approximately the same attitude as the fixed first jaw 12). Additionally, at least three longitudinal ribs 18A (see FIGS. 4A and 4B) are located on the inside surface 18 of the clamp body 11 extending from the clamp body partition 19 to the second end 15 of the clamp body 11. The ribs 18A stabilize and help prevent rotational movement, wobbling, or flexing of the second jaw 17 when it is being moved within the channel 16 in the direction of the longitudinal axis of the clamp body 11 Also, clamp body 11 wall thickness is slightly thicker at the end 13 of the clamp body 11 than it is at the end 15 as shown in FIGS. 4A and 4B. The wall thickness of the clamp body 11 at the end 13 near the partition 19 (i.e. above the partition 19 in FIGS. 3 and 4) generally remains constant.

2. First and Second Jaws

The first jaw 12 is generally attached to the outside surface 14 near end 13 of clamp body 11, and the second jaw 17 is adapted to be received within the clamp body 11 and is capable of moving along the running channel 16. In FIGS. 3 and 4, the first jaw 12 has a curved segment 12A which is generally attached perpendicularly to the longitudinal axis of the clamp body 11.

Three gripping components 23 are attached at an underside of the curved segment 12A. In the preferred embodiment, there are two outer positioned ribbed gripping components 23A and the inner positioned central ribbed gripping component 23B. Each gripping component 23 has a pair of spaced-apart ribs 24 having a generally concave curved surface 26, a flat surface 25 at one end of the component 23 which is attached to an end of the jaw 12 proximate to the clamp body 11; and a flat surface 27 at a distal end of the component 23. Preferably, the two outer positioned ribbed gripping components 23A project more from the curved segment 12A than the inner positioned central ribbed gripping component 23B.

The movable second jaw 17 has a gripping component 29 attached to a drive engage component 28. The gripping component 29 of the second jaw 17 is identical to the first jaw 12 except that inner sides of outer ribbed gripping components 23A which are attached to the first jaw 12 are configured to be positioned outside of and adjacent to outer sides of the outer gripping components 23A that are attached to the second jaw 17. In other words, the second jaw 17 is intentionally narrower than the first jaw 12 wherein the two outer gripping components 23 of the second jaw 17 are adapted to nestle within (i.e. not in direct opposite contact) the two outer gripping components 23 of the first jaw 12.

In FIG. 3, the drive engage component 28 has a cylindrical disk shape with an internally threaded axially symmetric drive aperture 33. The component 28 has an outer surfare 28A and an inner surface 28B. The internal threads of the drive aperture 33 are preferably made to left handed threads (i.e. they run counter to the standard direction). As shown in FIG. 4C, three or more channels 34 are located lengthwise in the outer area 28A of the drive component 28 wherein each channel 34 slidingly engages along and is received by a longitudinal rib 18A in the inside surface 18 of the clamp body 11. Thus, when the drive engage component 28 of the second jaw 17 is inserted inside of the clamp body 11, the channels 34 engage and slide along the longitudinal ribs 18A of the clamp body 11. This sliding engagement between the longitudinal ribs 18A and channels 34 prevents radial and longitudinal twisting, rotating, or rocking movement of the drive component 28 during use and also aids in guiding the drive component 28 along the longitudinal axis of the clamp body 11. In other words, the sliding engagement helps stabilize and prevent rotational movement, wobbling, or flexing of the second jaw 17 when it is being moved along the longitudinal axis of the clamp body 11.

In FIGS. 3, 4C, and 4E, the drive component 28 of the second jaw 17 also has two spring biasing upward projections 35 and a spring biasing downward projection 36. The spring biasing projections 35 and 36 are inset into the outer surface 28A of the drive component 28. A portion of the two upward projections 35 extends above the top surface of the drive component 28, while a portion of the downward projection 36 extends below the bottom surface of the drive component 28. The number of projections placed on the outer surface 28A of the drive component 28 are not limited to the numbers shown in FIGS. 3, 4C, and 4E, and any suitable number of projections may be used so long as there is at least one upward projection and one downward projection.

Figure 3A:
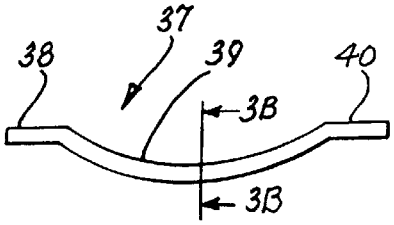
FIG. 3A is a side view of a rubber grip for the first and second jaws of the base clamp.
Figure 3B:
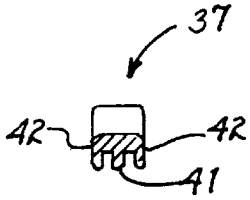
FIG. 3B is a cross-sectional view of the rubber grip according to the line 3B—3B of FIG. 3

Rubber grips 37 shown in FIGS. 3, 3A, and 3B are attached to each of the gripping components 23 on both the first jaw 12 and the second jaw 17. Each rubber grip 37 has a generally concave curved surface 39, a flat surface 38 at one end of the rubber grip 37, and another flat surface 40 at another end of the rubber grip 37. The rubber grip 37 is adapted to conform with the flat surface 25, the concave curved surface 26, and the flat surface 27 of each of the gripping components 23 of both the first jaw 12 and the second jaw 17. As shown in FIG. 3B, each rubber grip 37 has a central rib 41 which runs along the lengthwise direction of the rubber grip 37 and is adapted to be snugly received between a pair of spaced-apart ribs 24 of each gripping component 23. Additionally, two side walls 42 that are parallel to the central rib 41 also exist on the sides of each rubber grip 37, and the two side walls 42 are adapted to cover an outer surface of each gripping components 23. The rubber grip 37 may be frictionally held in place to the gripping component 23 or, preferably, it is permanently attached with an adhesive or the like.

3. Threaded Knob

Threaded knob 43 is used to drive the second jaw 17 within the channel 16 along the longitudinal axis of the clamp body 11. The threaded knob 43 has a cylindrical shaft 44 with left-handed external threads adapted to match the left-handed internal threads of the second jaw 17 (i.e. as stated earlier, the threads run counter to the standard direction). The external threads of the threaded knob 43 extend nearly the entire length of the cylindrical shaft 44, except for a final segment of a first end 45 and a second end 46 left unthreaded respectively. In the preferred embodiment, the cylindrical shaft 44 is a hollow shaft manufactured from polymers such as plastic or the like. The unthreaded portions serve to prevent over driving or over torquing the first and second jaws 12 and 17 in either an open or closed configuration. The spring biasing projections, discussed above, serve to help re-engage the drive component 28 onto the threaded portion of the threaded knob 43 when the second jaw 17 reaches either the top or bottom non-threaded portion of the threaded knob 43. Therefore, the spring biasing projections provides one of the important functions in helping prevent over driving of the second jaw 17 either toward the first jaw 12 by use of the upward projections 35 or toward the second end 15 of the clamp body 11 by use of the downward projection 36. In the preferred embodiment, each set of projections 35 and 36 is a pair of projections separated by 120 degrees of arc.

Drive knob 47 is attached to the first end 45 of the cylindrical shaft 44. The drive knob 47 includes a cylindrical internal flange 48 that is located and attached between the shaft 44 and the cylindrical knob grip 49 ( i.e. FIG. 3 shows that the knob grip 49 is attached to the outer perimeter of the flange 48). There is an inner cylinder 52 attached to a top surface of the internal flange 48, which is coaxial shaft 44. A plurality of equally spaced longitudinal gripping channels 51 are located on an outer surface 50 of the knob grip 49 so that they run the longitudinal length of the outer surface 50, and the gripping channels 51 provide a grip for the user to turn the knob 47. The length of the knob grip 49 is intentionally shortened to lessen the gripping surface, thereby preventing accidental over torquing.

A channel 53 exists between the inner cylinder 52 and the knob grip 49. This channel 53 is adapted to receive the second end 15 of the clamp body 11, thereby adding strength and support to the clamp body 11. The knob grip 49 is further adapted to receive a cup-shaped knob cap 54 at the second end 15 of the clamp body 11. As shown in FIG. 4, the knob cap 54, which may have a flat bottom 55 attached to a cylindrical side 56, covers any exposed edges and the inner workings of the threaded knob 43.

A shaft tip 57 having an outer surface is attached to the second end 46 of the threaded knob 43. In FIGS. 3 and 4, the shaft tip 57 has two downwardly sloping, engaging frustoconical rings 58. When the threaded knob 43 is mounted and inserted within the clamp body 11, the shaft tip 57 extends or projects through the aperture 20 of clamp body partition 19.

The threaded knob 43 is rotatably secured within the clamp body 11 by a knob clip 59. As shown in FIGS. 3 and 4, the knob clip 59 has a washer shaped base portion 60, and a cylindrically shaped, spacer portion 61 centrally attached to the base portion 60. Base portion 60 has an aperture 62 that is similarly shaped to the shaft tip 57, and the spacer portion 61 has a hollow interior 62A into which a portion of the shaft tip 57 is allowed to protrude and exist. Thus, the size of the aperture 62 must be slightly smaller than the size of the rings 58. In order to improve flexibility, the knob clip 59 has two parallel longitudinal channel cuts 63. These channel cuts 63 extend though the base portion 60 and partially into the spacer portion 61. Two flanges 64 are oppositely positioned and attached at the bottom of the spacer portion 61 in the interior area of the base portion 60 (i.e. FIG. 3 shows one of the two flanges 64, and the other flange 64 is located on the opposite side), and between the channel cuts 63. Preferably, the knob clip 59 is made from a polymer such a plastic or the like.

The threaded knob 43 is secured within the clamp body 11 by forcing the knob clip 59 down over the projecting shaft tip 57. As the knob clip 59 is mounted over the shaft tip 57, the flanges 64 of the knob clip 59 make contact with the rings 58 of the threaded knob 43 which forces and expands the flanges 64 outwardly. After the knob clip 59 is fully inserted in place over the rings 58, the flanges 64 of knob clip 59 then return from the expanded position to their original position, thus locking the threaded knob 43 into place.

The components of the general first end of the present invention such as the base clamp 10, clamp body 11, first jaw 12, second jaw 17, partition 19, threaded knob 43, drive knob 47, knob grip 49, knob cap 54, and knob clip 59 are preferably made by twenty percent (20%) glass fill (or urethane or glass bead fiber) polycarbonate or any other suitable plastic material. Other suitable materials can also be used to make these components. Rubber grips 37 are preferably made from a suitable elastomeric rubber material that will provide frictional gripping. However, any other suitable material that provides frictional gripping may be used.

B. The Support Arm of the Present Invention

Figure 5:
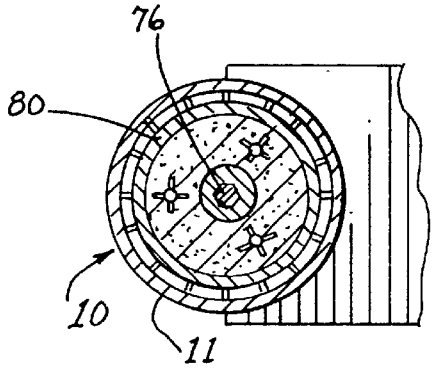
FIG. 5 is a cross-sectional view of the first embodiment of the present invention according to the line 5—5 of FIG. 4.
Figure 6:
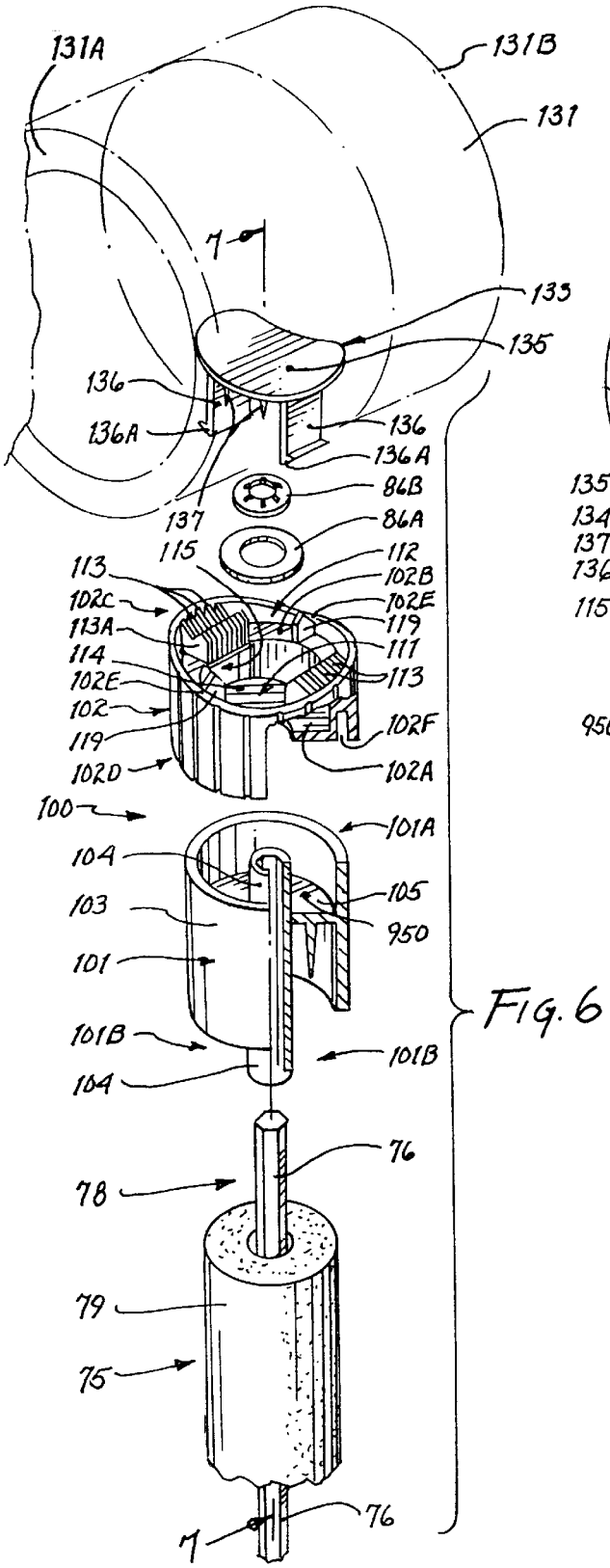
FIG. 6 is a cut-away exploded view of components at a general second end of the first embodiment of the present invention illustrating assembly of the components.

As shown in FIGS. 3 and 4, the support arm 75 is made of a generally bendable and flexible copper alloy support wire 76 that is surrounded by a foam tube 79 wherein the foam tube 79 has a hollow portion for receiving the support wire 76. As shown in FIG. 4, support arm 75 has a first end 77 attached to or keyed into a rotation cup 80, and as shown in FIG. 6, the support arm 75 has a second end 78 attached to the attachment interface 100. As shown in FIGS. 3, 5, and 6, the support wire 76 has a hexagonal cross section. The support wire 76 should be hexagonal at least at the first end 77 and the second end 78 of the support arm 75. In the preferred embodiment, the support wire 76 is hexagonal for the full length for simplicity in costs and manufacturing processes. The support wire 76 is encased or surrounded by a cylindrically- shaped, low density, expanded polymer, foam tube 79. The foam tube 79 has an inner diameter which is adapted to tightly receive the support wire 76. The foam tube 79 is secured into place by an adhesive such as low melting temperature glue or the like.

One method of securing the foam tube 79 to the support wire 76 is to coat the support wire 76 with a low temperature melting glue (i.e. including but not limited to dipping the support wire 76 into molten glue). The molten glue is allowed to cool and harden, thus forming a hard outer coating on the support wire 76. This glue coated wire 76 is then inserted into the hollow portion 79A of the foam tube 79 and heated by methods such as applying direct or alternating current to the support wire 76, or using radio frequency heating. The heat generated by the support wire 76 melts the coated glue. When the melted glue cools, it forms a secure bond between the support wire 76 and the foam tube 79.

An alternate method of securing the foam tube 79 to the support wire 76 is to provide a long hollow tube-shaped glue structure (i.e. such as a mold made of solid glue material). The glue structure is fitted over the support wire 76. This glue structure and support wire assembly is then received into the foam tube 79, and the support wire 76 is heated to melt the glue, and the glue is allowed to re-solidify to form a secure bond between the support wire 76 and the foam tube 79. In the preferred embodiment, a low melting temperature glue is used to secure the foam tube 79 to the support arm 75 so that the foam tube 79 is not melted when the glue is being melted.

The wire 76 of the support arm 75 is preferably made from a resilient copper alloy that will provide flexible positioning of the arm 75. However, any other suitable material that provides flexible positioning of the arm 75 can also be used to make the wire 76. Furthermore, the foam tube 79 of the support arm 75 is preferably made from expanded polyethylene material which provides an insulated and soft exterior surface for the support arm 75. However, any other suitable material that provides an insulated and soft exterior surface for the support arm 75 can also be used to make the tube 79.

C. The Rotation Cup of the Present Invention

As seen in FIGS. 3 and 4, the support wire 76 is attached to or keyed into the rotation cup 80. The rotation cup 80 is a cylindrical, receiving component. The rotation cup 80 has a main cylindrical cup portion 81 with a bottom flat base 82 having an interior side 82A and an exterior side 82B wherein the main cup portion 81 receives the first end 77 of the support arm 75. The main cup portion 81 also has a tubular knob receiving portion 83 appended from the exterior side 82B wherein the knob receiving portion 83 is fittingly inserted over and outside of the exterior 62B of spacer portion 61 of knob clip 59. Furthermore, a hollow tubular portion 84 is concentrically and centrally attached to the interior side 82A of the flat base 82 so that the hollow interior of the tubular portion 84 is aligned with a central opening 85 in the bottom base 82. A radial flat-sided retainer flange 86 is attached to the main cup portion 81 (i.e. as shown in FIGS. 3 and 4, the flange 86 is attached to a generally upper portion of the flange 86), and the flange 86 retains the rotation cup 80 within and at the top portion of the clamp body 11 at end 13.

The support wire 76 is inserted and tightly received within an inner channel of the hollow tubular portion 84. The hexagonal cross section of the support wire 76 provides a tight, non-rotatable fit by providing edges which press into the material of the foam 79. The foam tube 79 snugly fits within the channel that exists between the main cup portion 81 of the rotation cup 80 and the hollow tubular portion 84. The first end 77 of the support wire 76 extends through the main cup portion 81 via the channel of the tubular portion 84, into the hollow interior of the knob receiving portion 83, and into and through the threaded knob 43 and out the end of the cylindrical internal flange 48 wherein the first end 77 of the support wire 76 is applied a washer 86A and a speed nut 86B. The first end 77 of the support wire 76 is generally secured in or keyed into place by means well known in the art, preferably with a washer 86A and a speed nut 86B.

In FIGS. 3 and 4, the bottom part of the main cup portion 81 is received within the first end 13 of the clamp body 11 wherein the knob receiving portion 83 is fitted around the projecting shaft tip 57 and knob clip 59 of the threaded knob 43. The radial flange 86 abuts the first end 13, thus defining the depth at which the rotation cup 80 may be inserted into and received by the clamp body 11. The rotation cup 80 is rotatably secured in the clamp body 11 by a retainer ring 87. The retainer ring 87 fits over the foam tube 79 and screws down onto the external threading on the first end 13 of the clamp body 11. The retainer ring 87 has a ring shaped retainer base 88 and a tubular grasping portion 89 at the outer perimeter of the retainer base 88. Internal threads are located on an inner surface of the tubular grasping portion 89. A plurality of equally spaced longitudinal channels 90 run along the longitudinal length of an outer surface of the tubular grasping portion 89, and these channels 90 provide gripping for securing the arm to the base clamp 10. The angular position of the rotation cup 80 may be fixed by tightening the retainer ring 87 onto the clamp body 11 causing the radial retainer flange 86 to be sandwiched or squeezed between the first end 13 of clamp body 11 and the retainer ring 87.

The rotation cup 80 is preferably made by twenty percent (20%) glass fill (or urethane or glass bead fiber) polycarbonate or any other suitable plastic material. Other suitable materials, however, can also be used to make this components so long as the cup 80 is able to received and interfaced with the support arm 75.

D. The General Second End of the Present Invention

1. Attachment Interface a. Lower Interface

Figure 7A:
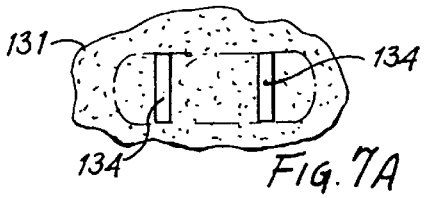
FIG. 7A is a view of the bottle or cup holder in the direction of the line 7A—7A wherein the pringle is not shown.
Figure 7:
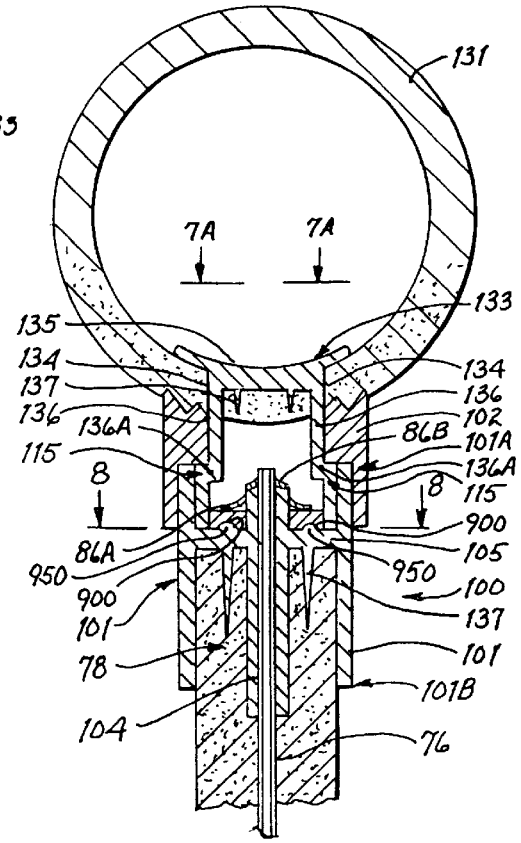
FIG. 7. is a cross-sectional side view of the first embodiment of the present invention on according to the line 7—7 of FIG. 6 which shows the working relationship of said components to each other.
Figure 8:
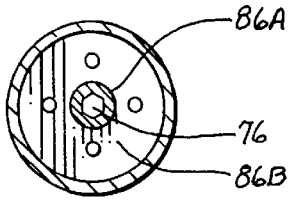
FIG. 8 is a cross-sectional view according to the line 8—8 of FIG. 7.

FIGS. 6, 7, and 8 show various views of the attachment interface 100 at the general second end 400 of the present invention apparatus 1. The attachment interface 100 has a lower interface component 101 rotatably secured to an interface mid component 102. The lower interface component 101 has a generally hollow outer cylindrical body 103, an inner hollow cylinder 104 positioned concentrically within the cylindrical body 103, and a circular partition 105 having flat sides wherein the flat sides of the partition are perpendicular to the longitudinal axes of the body 103 and cylinder 104. The inner cylinder 104 and outer body 103 of the lower interface component 101 are coplanar at end 101A respectively, whereas the inner cylinder 104 extends beyond the outer cylindrical body 103 at end 101B. The circular partition 105 is positioned between the cylinder 104 and outer cylindrical body 103 at a location relatively closer to the end 101A. In the preferred embodiment, the circular partition 105 is located approximately one fourth (¼) of the length of the cylindrical body 103 from the end 101A, or one sixth (⅙) of the length of the cylinder 104 from the end 101A.

The lower interface component 101 is preferably made by twenty percent (20%) glass fill (or urethane or glass bead fiber) polycarbonate or any other suitable plastic material. Other suitable materials, however, can also be used to make this component.

b. Interface Mid

The interface-mid component 102 is also a generally hollow cylinder having a flat base 102A and an annular edge component 102B. The interior portion of the component 102 comprises a lower cylindrical hollow area 111 and an upper cylindrical hollow area 112. Pringle retaining hollows 115 are located opposite from each other within the lower hollow area 111 for receiving and retaining a pringle 133. A plurality of equally spaced, parallel fin gripping components 113 are located on the annular edge component 102B, and they generally extend from the annular edge component 102B to an end 102C. A portion 113A of each of these gripping components 113 extend above the top portion of the mid-interface component 102 which function to guide the pringle 133 into the interface mid component and also functions as a spacer between the interface mid component 102 and pringle 133. The base 102A and the annular edge component 102B of the interface-mid component are coplanar at end 102D. At end 102C, the top portion of the interface component 102 is curved downwards at the mid-section 102E to conform to the bottom convex shape of the pringle 133. Two other projecting fins 119 are located oppositely from each other at the downardly curved mid-section 102E. The projecting fins 119 also function as spacers between the interface component 102 and the pringle 133.

A circular channel 102F in the interface-mid component 102 is located at the bottom side of the component 102 at end 102D, and the circular channel 102F is a circular groove that is defined by the main portion of the flat base 102A and an outer perimeter wall of the component 102. The circular channel 102F is placed over and receives the cylindrical body 103 of the lower interface 101 at the end 101A. The end of inner cylinder 104 of the lower interface 101 near the end 101A extends through an opening through flat base 102A. The second end 78 of the support wire 76 is inserted through the hollow portion of the inner cylinder 104 of the lower interface 101 wherein a portion of the second end 78 of the support wire 76 extends through the inner cylinder 104 of the lower interface 101 near end 101B. The interface assembly 100 is secured to the second end 78 of the support wire 76 by components or methods well known in the art, such as washer 86A and speed nut 86B or the like. Appropriate securing components will provide sufficient frictional forces to maintain an attachment to the interface assembly 100 in a particular position.

Furthermore, one advantage of the present invention is that the tension of the support wire 76 between the attachment interface 100 and the rotation cup 80 can be adjusted during manufacture of the flexible arm apparatus 1 by allowing the washers 86A and speed nuts 86B to be tightened at the desired positional length of the support wire 76. Angular or rotational repositioning of the attachment that is attached to the support arm 75 is accomplished by overcoming the frictional compressive forces in the interface assembly 100 (i.e. the attachment can then be rotated in different angular or rotational positions).

The interface mid component 102 is preferably made by twenty percent (20%) glass fill (or urethane or glass bead fiber) polycarbonate or any other suitable plastic material. Other suitable materials, however, can also be used to make this component.

Furthermore, a number of dips 900 can be located on the bottom side of the flat base 102A of the interface mid component 102, and a number of corresponding pips 950 can be located on the top side of the partition 105 of the lower interface component 101. Each dip 900 is able to rotatingly engage each of the different pips 950 which allows the bottle or cup holder 131 to be rotated to different (i.e. segmented) angular levels (i.e. the engaging pips 950 into the dips 900 provide segmented rotation between the interface mid component 102 and the lower interface component 101).

2. Pringle

The attaching pringle 133 has an arcuate shaped portion 135 with engaging feet 136. The arc of the pringle 133 is substantially shaped with the same contour or curvature of the inner portion of the foam cylinder holder 131. The engaging feet 136 of the pringle 133 are attached to an outer convex surface of the arcuate shaped portion 135. Each engaging foot 136 has an upwardly sloping engaging portion 136A. The engaging feet 136 can be inserted through engaging channels 134 of bottle or cup holder 131 such as shown in FIG. 7A. Furthermore, four foam biting prongs 137 are attached to the outer convex surface of the arcuate shaped portion 135 and located between the engaging feet 136.

The portion 113A of each gripping component 113 of the interface-mid component 102 guides the two engaging feet 136 towards the pringle retaining hollows 115 of the interface-mid component 102. The respective engaging portions 136A of the engaging feet 136 force the feet 136 to slightly bend inward from their preferred position as they are guided toward the pringle retaining hollows 115. When the feet 136 reach a position such that the engaging portions 136A are no longer in contact with the gripping component 113 but in the pringle retaining hollows 115, then the feet 136 return from their bent positions to their normally preferred positions. The pringle 133 then locks in place with the interface-mid 102 so that the a portion of the attachment (i.e. a foam portion of a holder 131) is sandwiched and secured between the pringle 133 and the interface-mid 102. The biting prongs 137 stick or poke into the foam bottle or cup holder 131, and the gripping components 113 of the interface mid component 102 grip the foam bottle or cup holder 131.

The pringle 133 is preferably made by twenty percent (20%) glass fill (or urethane or glass bead fiber) polycarbonate or any other suitable plastic material. Other suitable materials, however, can also be used to make this component.

E. Various Attachment Embodiments of the Present Invention

The present invention has several attachments 131, 140, 150, or any other suitable attachment that can be used with the present invention. One attachment embodiment for the present invention is a bottle, cup, or container holder 131 as shown in FIGS. 1 and 2. The holder 131 is a hollow foam cylinder that has open ends 131A and 131B. The holder 131 is made of low-density polymer or the like and is able to expand to fittingly hold a bottle, cup, container, etc. The holder 131 has two engaging channels 134 which are longitudinally located in the foam cylinder. See FIG. 7A. The bottle or cup holder 131 is preferably made from expanded polyethylene material which provides an insulated and soft exterior surface for flexible arm apparatus 1. However, any other suitable material that provides an insulated and soft exterior surface can also be used to make the holder 131.

Figure 9:
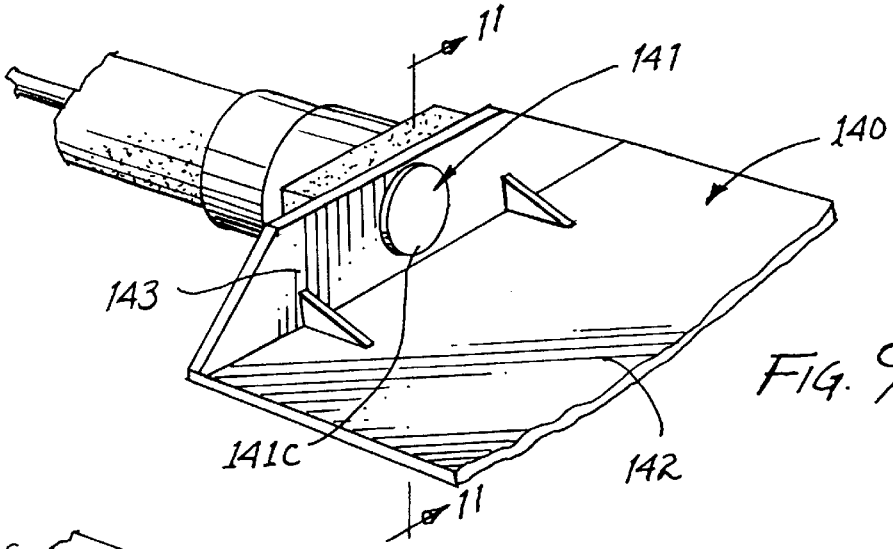
FIG.9 is a perspective view of a second embodiment of the present invention wherein the second embodiment has a tray attached at one end.
Figure 11:
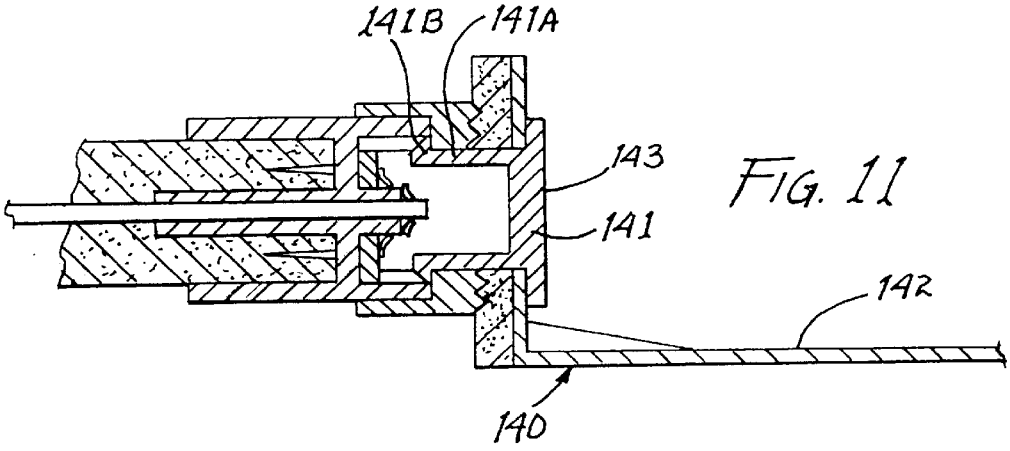
FIG. 11 is a cross-sectional side view according to the line 11—11 of FIG. 9 which shows the working relationship of the components at the one end.

A second attachment embodiment is a tray 140 as shown in FIGS. 9 and 11. The tray 140 is attached to the present invention by using a pringle 141 that is similar to the pringle 133 that was described above. Pringle 141, however, is slightly different from pringle 133 in that pringle 141 is planar instead of arcuately shaped. Pringle 141 also has engaging feet 141A attached to an outer flat surface of the planar shaped portion 141C. Each of the engaging feet 141A has an upwardly sloping engaging portion 141B. The tray 140 has at least a bottom retaining section 142 and a side attaching section 143. The pringle 141 secures the tray to the section 143. Preferably, wedge-shaped supports 144 are attached as further supports between the attaching section 143 and the bottom section 142.

Figure 10:
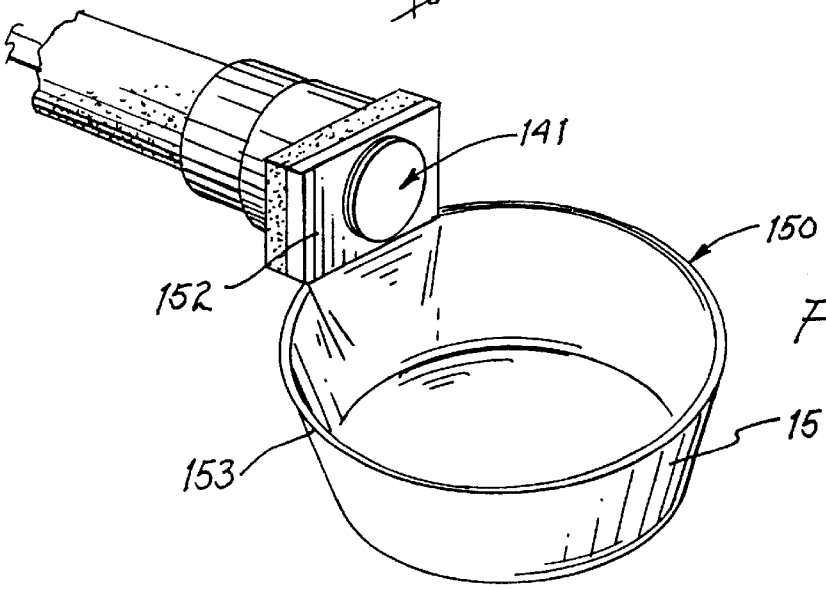
FIG.10 a perspective view of a third embodiment of the present invention wherein the third embodiment has a bowl attached at one end.

A third attachment embodiment is a bowl 150 as shown in FIG. 10. The bowl 150 also uses the same pringle 141 as the second attachment embodiment. The bowl 150 is a bowl-shaped container 151 with a flange 152 attached to the rim 153 of the container 151. The pringle 141 secures the bowl 150 to the attachment interface 100 through at least one aperture in the flange 152.

Any suitable material can be used to make the tray 140 and the bowl 150. Furthermore, the pringle 141 is preferably made by twenty percent (20%) glass fill (or urethane or glass bead fiber) polycarbonate or any other suitable plastic material. Other suitable materials, however, can also be used to make this component.

The preferred method of manufacture for the present invention is to use the materials (i.e. including but not limited to plastic, foam, etc.) described above since these materials provide a soft exterior or outer feel of the flexible arm apparatus 1 and a safer environment for children. However, any other suitable material(s) may be used to accomplish and provide the same or similar advantages, The flexible arm apparatus 1 of the present invention can be attached to a number of different articles with various respective uses and applications. The flexible arm apparatus 10 is used by attaching it to a surface (i.e. including but not limited to the examples of different tables, chairs, seats, baby seats, baby carriers, etc.) A portion of the surface is placed between the jaws 12 and 17 of the base clamp 10. The threaded knob 43 is rotated until the jaws 12 and 17 both come into contact and clamp onto (i.e. sandwich) the surface. It is important to note that a major advantage of the present invention is that the threaded knob 43 is a worm drive or worm screw and remains stationary (i.e. the threaded knob 43 travel with either jaw 12 or 17). An attachment, such as a bottle or cup holder 131, tray 140, or bowl 150, is attached to the attachment interface 100 and the attachment is then used for its capable purposes (i.e. baby bottle 500 is inserted into the bottle holder 131 as shown in FIG. 1). The support arm 75 is flexed into a configuration which can place the bottle 500 into close proximity with the baby 600 when in use or away from the baby 600 when not in use. The interface-mid component 102 and lower interface 101 may be rotated relative to each other in order to provide a better orientation of the attachment (i.e. rotate bottle 500 to the baby 600 when in use and rotate bottle 500 away from the baby 600 when not in use). Furthermore, the support arm 75 may be rotated relative to the base clamp 10 by slightly releasing the retainer ring 87 and rotating the support arm 75. The retainer ring 87 may then be re-tightened to prevent the support arm 75 from further rotating. When the flexible arm apparatus 1 is not being used, it may be removed from the attached surface by rotating the threaded knob 43 until the jaws 12 and 17 come apart from the surface.

The foregoing description of preferred embodiments and best mode of the invention known to applicant at the time of filing the application has been presented for the purposes of illustration and description. It is not intended to be exhaustive or to limit the invention to the precise form disclosed, and many modifications and variations are possible in the light of the above teaching. The embodiments were chosen and described in order to best explain the principles of the invention and its practical application, and to enable others skilled in the art to best utilize the invention in various embodiments and with various modifications as are suited to the particular use contemplated.

Likewise, any use of the words "function" or "means" in the Detailed Description is not intended to indicate a desire to invoke the special provisions of 35 U.S.C. Sec. 112, Paragraph 6 to define his invention. To the contrary, if the provisions of 35 U.S.C. Sec. 112, Paragraph 6 are sought to be invoked to define the invention, the claims will specifically state the phrases "means for" or "step for" and a function, without reciting in such phrases any structure, material, or act in support of the function. Even when the claims recite a "means for" or "step for" performing a function, if they also recite any structure, material, or acts in support of that means or step, then the invention is not to invoke the provisions of 35 U.S.C. Sec. 112, Paragraph 6. Moreover, even if the inventors invoke the provisions of 35 U.S.C. Sec. 112, Paragraph 6 to define the invention, it is the intention that the invention not be limited only to the specific structure, material, or acts that are described in his preferred embodiment. Rather, if the claims specifically invoke the provisions of 35 U.S.C. Sec. 112, Paragraph 6, it is nonetheless the intention to cover and include any and all structures, materials, or acts that perform the claimed function, along with any and all known or later developed equivalent structures, materials, or acts for performing the claimed function.

What is claimed is:

1. A flexible arm apparatus comprising:

a) a clamp assembly having a first jaw and a second jaw;

b) a screw that couples the first jaw to the second jaw wherein the screw is used to drive the clamp assembly;

c) a flexible support arm having a first end attached to the clamp assembly;

d) a lower interface component attached to a second end of the support arm;

e) an interface-mid component movably attached to the lower interface component to allow rotational movement between the interface-mid component and the lower interface component;

f) an attaching component having at least one attaching mechanism that engages to the interface-mid component wherein the attaching component is able to secure an attachment to the interface-mid component;

g) a rotation cup interfaced between the clamp assembly and the support arm wherein a portion of the rotation cup is placed in the clamp assembly and the rotation cup allows the support arm to be adjustably rotated to various positions relative to the clamp assembly, and h) a retainer ring that is fitted around the support arm and secured to the clamp assembly wherein the retainer ring secures the support arm in a particular rotated position.

2. The flexible arm apparatus of claim 1 wherein the clamp assembly further comprises:

a) a tubular clamp body having the first jaw securely attached thereto; and b) the second jaw moveably received by the tubular clamp body.

3. The flexible arm apparatus of claim 2 wherein the screw is housed within the tubular clamp body.

4. The flexible arm apparatus of claim 3 wherein the screw is a worm screw that is generally attached at two ends within the tubular clamp body and the worm screw is rotated to drive the second jaw along a lengthwise axis of the tubular clamp body.

5. The flexible arm apparatus of claim 2 wherein the screw further comprises a threaded knob having:

a) a cylindrical shaft with a first end and a second end;

b) external threading located along a generally middle length surface of the cylindrical shaft;

c) a non-threaded portion generally located at the first end;

d) a drive knob attached to the first end of the cylindrical shaft;

e) another non-threaded portion generally located at the second end; and f) a shaft tip attached to the second end of the cylindrical shaft.

6. The flexible arm apparatus of claim 5 wherein the drive knob further comprises:

a) a washer-shaped knob flange; and b) a cylindrical hand grip attached to an outer perimeter of the knob flange to define a cylindrical channel that receives a second end of the clamp body wherein the drive knob is able to rotatingly move within the cylindrical channel.

7. The flexible arm apparatus of claim 1 wherein the support arm further comprises:

a) a support wire with a first end and a second end; and b) a foam cover that encloses the support wire.

8. The flexible arm apparatus of claim 7 wherein:

a) the support wire further has a hexagonal cross section; and b) the foam cover is manufactured from a low density, expandable polymer and has a corresponding hexagonal shaped hollow for receiving the support wire.

9. The flexible arm apparatus of claim 1 wherein the lower interface component further comprises:

a) a hollow outer cylindrical body, b) an inner hollow cylinder positioned concentrically within the outer cylindrical body wherein the inner cylinder is coplanar with the cylindrical body at one end and wherein the inner cylinder extends beyond the outer cylindrical body at another end; and c) a circular partition attached between the inner hollow cylinder and the outer cylindrical body wherein circular partition is positioned relatively near the one end.

10. The flexible arm apparatus of claim 1 wherein the interface-mid component further comprises:

a) retaining hollows located in the interior portions of the interface-mid component for receiving and retaining the attaching component;

b) gripping components located in the interface-mid component to guide the attaching component so that the attaching component is engaged with the interface-mid component and wherein the gripping components are able to grip an attachment, and c) fins located in the interface-mid component to function as spacers between the interface-mid component and the attaching component.

11. The flexible arm apparatus of claim 1 wherein the attachment is a bottle or cup holder for holding a baby bottle or cup.

12. The flexible arm apparatus of claim 1 wherein the attachment is a tray for holding various articles.

13. The flexible arm apparatus of claim 1 wherein the attachment is a bowl.

14. A flexible arm apparatus comprising:

a) a clamp assembly having a first jaw and a second jaw, b) a worm screw that couples the first jaw to the second jaw wherein the worm screw is generally attached at two ends within the clamp assembly and is rotated to drive the second jaw along a lengthwise axis of the clamp assembly;

c) a support arm having a first end attached to the clamp assembly;

d) an attachment interface attached to a second end of the support arm, wherein said attachment interface is adapted to receive an attachment;

e) an attaching component having at least one attaching mechanism that engages to the attachment interface wherein the attaching component is able to secure an attachment to the attachment interface;

f) a rotation cup interfaced between the clamp assembly and the support arm wherein a portion of the rotation cup is placed in the clamp assembly and the rotation cup allows the support arm to be adjustably rotated to various positions relative to the clamp assembly, and g) a retainer ring that is fitted around the support arm and secured to the clamp assembly wherein the retainer ring secures the support arm in a particular rotated position.

15. The flexible arm apparatus of claim 14 wherein the attachment interface further comprises:

a) a lower interface component attached to a second end of the support arm; and b) an interface-mid component movably attached to the lower interface component to allow rotational movement between the interface-mid component and the lower interface component.

16. A method of making a flexible arm apparatus comprising the steps of:

a) providing a clamp assembly having a first jaw and a second jaw;

b) coupling the first jaw to the second jaw by use of the screw which is used to drive the clamp assembly;

c) attaching a first end of a support arm to the clamp assembly;

d) attaching a lower interface component to a second end of the support arm;

e) movably attaching an interface-mid component to the lower interface component so that rotational movement is allowed between the interface-mid component and the lower interface component;

f) engaging an attacking component having at least one attaching mechanism to the interface-mid component wherein the attaching component is able to secure an attachment to the interface-mid;

g) interfacing a rotation cup between the clamp assembly and the support arm wherein a portion of the rotation cup allows the support arm to be adjustably rotated to various positions relative to the clamp assembly; and h) fitting a retainer ring around the support arm and secured to the clamp assembly wherein the retainer ring secures the support arm in a particular rotated position.

17. The method of making a flexible arm according to claim 16 wherein coupling step further comprises the step of:

coupling the first jaw to the second jaw by use of a worm screw wherein the worm screw is generally attached at two ends within the clamp assembly and the worm screw is rotated to drive the second jaw along a lengthwise axis of the tubular clamp body.

18. The method of making a flexible arm according to claim 16 wherein the attachment in the engaging step is a bottle or cup holder for holding a baby bottle or cup.

19. A method of using a flexible arm apparatus comprising a clamp assembly having a first jaw and a second jaw, a screw that couples the first jaw to the second jaw wherein the screw is used to drive the clamp assembly, a support arm having a first end attached to the clamp assembly, a lower interface component attached to a second end of the support arm, an interface-mid component movably attached to the lower interface component to allow rotational movement between the interface-mid component and the lower interface component, an attaching component having at least one attaching mechanism that engages to the interface-mid component wherein the attaching component is able to secure an attachment to the interface-mid component, a rotation cup interface between the clamp assembly and the support arm wherein a portion of the rotation cup is placed in the clamp assembly and the rotation cup allows the support arm to be adjustably rotated to various positions relative to the clamp assembly. and a retainer ring that is fitted around the support arm and secured to the clamp assembly wherein the retainer ring secures the support arm in a particular rotated position, comprising the steps of a) attaching an attachment between the attaching component and the interface-mid component;

b) positioning the clamp assembly near a surface to which the flexible arm apparatus is to be attached;

c) rotating the screw so that the second jaw drives towards the first jaw and removably clamps the surface;

d) moving the support arm to a desired position;

e) rotating the rotation cup and the support arm to the particular rotated position;

f) securing the retainer ring to the clamp assembly to secure the support arm to the particular rotated position; and g) rotating the interface-mid component relative to the lower interface component so that the attachment is moved to a desired position.

20. The method of using a flexible arm apparatus according to claim 19 wherein the moving step further comprises the steps of:

a) adjustably fixing one end of the support arm to the clamp assembly; and b) angularly positioning the support arm to the desired position.

* * * * *